US005617835A

United States Patent [19]

Awarzamani et al.

[11] Patent Number: 5,617,835

[45] Date of Patent: Apr. 8, 1997

[54] INLET VALVE FOR A COMBUSTION SPACE OF AN INTERNAL COMBUSTION ENGINE

[75] Inventors: Assadollah Awarzamani, Markgroeningen; Thomas Wilfert, Ludwigsburg, both of Germany

[73] Assignee: Robert Bosch GmbH, Stuttgart, Germany

[21] Appl. No.: 597,769

[22] Filed: Feb. 7, 1996

[30] Foreign Application Priority Data

Feb. 9, 1995 [DE] Germany ..... 1 95 04 239.5

[51] Int. Cl.[6] ..... F02M 23/12; F01L 1/28

[52] U.S. Cl. ..... 123/585; 123/188.7

[58] Field of Search ..... 123/188.7, 188.14, 123/296, 585

[56] References Cited

U.S. PATENT DOCUMENTS

| | | | |
|---|---|---|---|
| 1,799,397 | 4/1931 | Taylor et al. | 123/296 X |
| 2,170,267 | 8/1939 | Rich | 123/188.3 X |
| 2,819,704 | 1/1958 | Niederman | 123/41.17 |
| 3,382,850 | 5/1968 | Baudry et al. | 123/274 X |
| 4,313,410 | 1/1982 | Kunii et al. | 123/585 X |
| 4,976,248 | 12/1990 | Rowe | 123/188.11 X |

FOREIGN PATENT DOCUMENTS

| | | | |
|---|---|---|---|
| 1401216 | 10/1965 | France . | |
| 2319011 | 2/1977 | France . | |
| 2048228 | 4/1972 | Germany . | |
| 3600067 | 7/1987 | Germany . | |
| 59-99028 | 6/1984 | Japan | 123/585 |
| 59-158363 | 9/1984 | Japan | 123/585 |
| 09667 | 5/1916 | United Kingdom . | |

*Primary Examiner*—Tony M. Argenbright
*Attorney, Agent, or Firm*—Edwin E. Greigg; Ronald E. Greigg

[57] ABSTRACT

In known inlet valves, condensation of the fuel, which is precipitated in the form of a wall film, occurs at the inlet valve, in particular when the internal combustion engine is in the cold state. Relatively large fuel droplets, which cause an increase in the harmful components in the exhaust gas, can break away from the wall film. The inlet valve according to the invention has a hollow shaft into which compressed air flows via at least one inlet shaft opening, the compressed air then flowing out again from at least one outlet opening which is provided on one side of the inlet valve facing away from the combustion space of the internal combustion engine. As a result of the outflowing compressed air, an air film is produced around the valve head, which air film prevents condensation of the fuel. The inlet valve is provided in particular for mixture-compressing, spark ignition internal combustion engines.

10 Claims, 1 Drawing Sheet

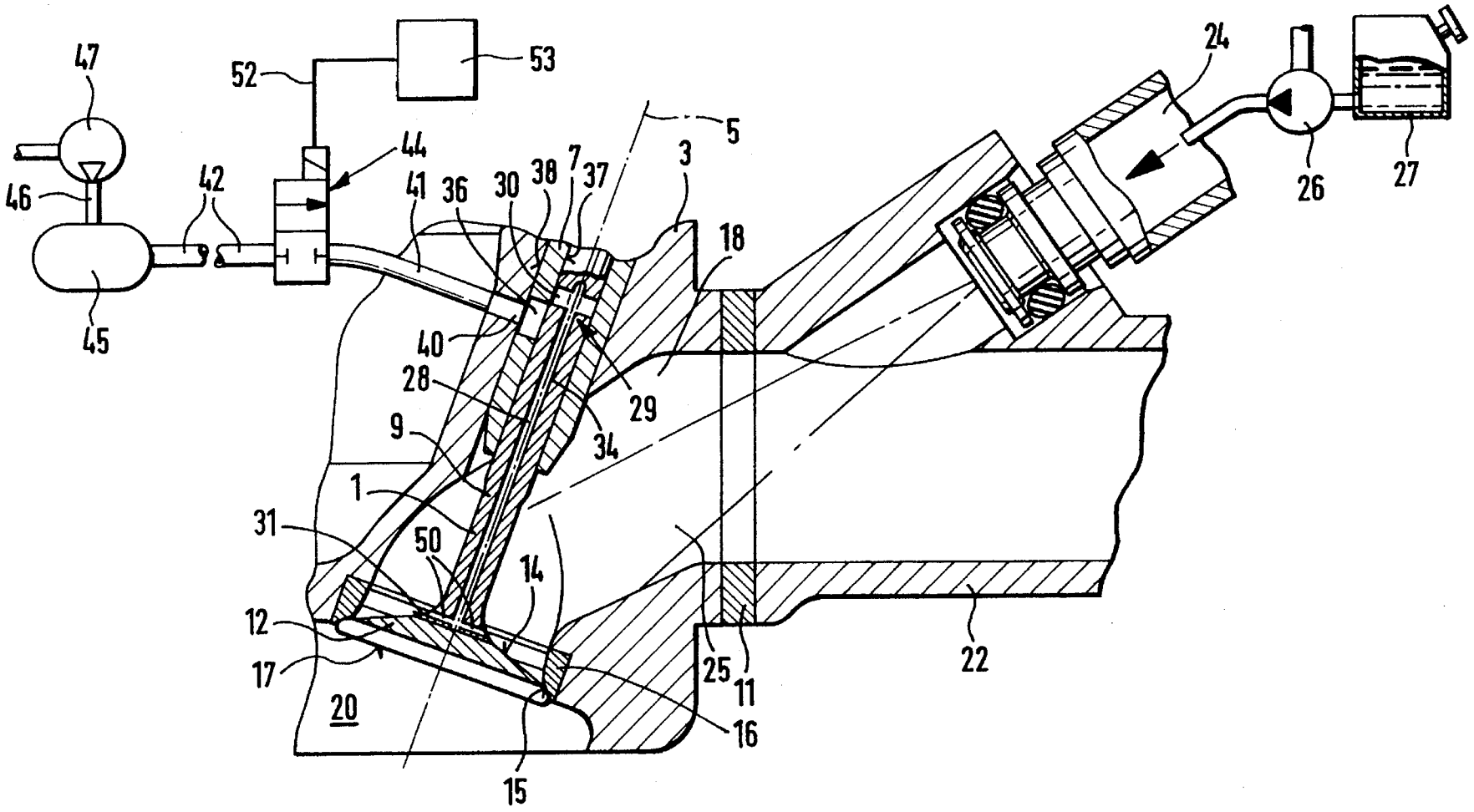
27
26
24
22
11
16
25
18
5
3
29
34
37
7
38
30
36
41
40
28
9
1
50
14
15
20
31
12
17
53
44
52
42
47
46
45

INLET VALVE FOR A COMBUSTION SPACE OF AN INTERNAL COMBUSTION ENGINE

PRIOR ART

The invention is based on an inlet valve for a combustion space of an internal combustion engine. An inlet valve which has a hollow shaft in which an outlet valve is displaceably mounted is already known (German Offenlegungsschrift 36 00 067). The outlet valve has an outlet valve head which is part of an inlet valve head of the inlet valve, specifically of the type in which in the closed position of the outlet valve the outlet valve head terminates flush with the inlet valve head. In the open position of the outlet valve, the outlet valve head is lifted off from the inlet valve head in order to lead out of the combustion space the exhaust gases enclosed in a combustion space of the internal combustion engine after combustion, via the hollow shaft of the inlet valve. In this arrangement, the exhaust gases flow out of the hollow shaft of the inlet valve out of a plurality of outlet ports which are made in the form of slits in an outer surface of the hollow shaft. When the inlet valve is opened, the outlet valve is closed so that a fuel/air mixture can be sucked in from an inlet passage via the open inlet valve.

The fuel/air inlet mixture is usually conditioned by a fuel injection valve which emits the fuel in the form of a jet of fuel in the direction of the inlet valve. The fuel leaving the fuel injection valve becomes decomposed during this process into extremely fine fuel droplets in order to produce a fuel/air mixture which is as homogeneous as possible. At the same time, in particular when the internal combustion engine is in the cold state or when sudden load changes occur, the fuel droplets may condense on the inner walls of the inlet passage, on inner walls of the combustion space and in particular on the valve head of the inlet valve, a wall film of fuel being formed. Only relatively large droplets of fuel can break free of such a wall film, the said large droplets of fuel then leading to a locally overrich fuel/air mixture in the combustion space. However, an overrich fuel/air mixture burns only incompletely so that the proportion of harmful components in the exhaust gas is correspondingly increased.

ADVANTAGES OF THE INVENTION

The inlet valve according to the invention has, in contrast, the advantage that condensation of the fuel emitted for example by a fuel injection valve is avoided in a simple manner. As a result, an increase in the harmful components in the exhaust gas which otherwise takes place during a cold start and the warming up phase as well as in certain operating ranges of the internal combustion engine is advantageously avoided. Moreover, with the inlet valve constructed according to the invention the consumption of fuel of the internal combustion engine is also reduced. It is also advantageous that the inlet valve according to the invention has an extended service life compared to the prior art.

Advantageous developments and improvements of the inlet valve disclosed are possible by virtue of the measures specified hereafter.

BRIEF DESCRIPTION OF THE DRAWING

An exemplary embodiment of the invention is illustrated in simplified form in the drawing and explained in greater detail in the subsequent description.

DETAILED DESCRIPTION OF THE EXEMPLARY EMBODIMENT

The drawing shows, in a partially sectional view, an inlet valve 1 which is designed according to the invention and is provided in particular for a mixture-compressing, spark ignition internal combustion engine. The inlet valve 1 is accommodated in a cylinder head 3 of the internal combustion engine and displaceably mounted for example in a valve guide sleeve 7. The inlet valve 1 has a valve head 12 which has a planar valve closing face 17, facing a combustion space 20 of the internal combustion engine, and a valve head face 14, facing away from the combustion space 20. The valve head face 14 merges, with curvature, into a cylindrical shaft 9 of the inlet valve 1 which ends at an actuation end (not illustrated in greater detail) outside the cylinder head 3. In order to actuate the inlet valve 1, for example a toggle lever engages in a known manner at the actuation end of the shaft 9, which toggle lever returns the inlet valve 1 into an open position and into a closed position by means of a valve spring.

The inlet valve 1 is illustrated in its closed position in the drawing in which closed position an annular section of the valve head face 14 bears against a valve seat 15 which is of, for example, conical construction. The valve seat 15 is formed, for example, by a sleeve-shaped valve insert 16 which is introduced into the cylinder head 3 for example by means of a press fit. In the open position of the inlet valve 1 with the valve head face 14 lifted off from the valve seat 15 a flow connection, which connects an inlet passage 18 to the combustion space 20 of the internal combustion engine via the open inlet valve 1, is cleared.

The inlet passage 18 is connected to an intake manifold 22 of the internal combustion engine, for example via a sealing ring 11. The inlet valve 1 opens, as is known, during the downwardly directed movement of a piston which can be displaced in the combustion space 20, air being sucked in from the surroundings via the intake manifold 22. Fuel is admixed to the sucked-in air, for example in the intake manifold 22, in order to obtain a fuel/air mixture which is capable of being ignited for the subsequent combustion in the combustion space 20. In order to condition the fuel, for example an electromagnetically actuated fuel injection valve 24 is provided which is attached to the intake manifold 22 so that the fuel is emitted in the direction of the inlet valve 1 into the intake manifold 22 and the inlet passage 18 in the form of a more or less directed, for example conical jet 25 of fuel. In order to supply fuel, the fuel injection valve 24 (illustrated only partially in the drawing) is connected via a fuel distributor (a so-called fuel rail) to a fuel feed pump 26 which feeds the fuel out of a fuel vessel 27.

The fuel emitted by the fuel injection valve 3 decomposes downstream of the fuel injection valve 24 into extremely fine droplets of fuel which become mixed with the flowing air in the intake manifold 22 and in the inlet passage 18 so that a fuel/air mixture which is as homogeneous as possible is produced. When the inlet valve 1 is open, the fuel/air mixture flows into the combustion space 20, is ignited and burns there with the inlet valve 1 closed. In order to maintain combustion of the fuel/air mixture which is as complete as possible in particular in the cold start phase and the subsequent warming phase as well as in specific operating ranges of the internal combustion engine, it is necessary to prevent condensation of the fuel emitted by the fuel injection valve 24 on walls of the intake manifold 22, on walls of the inlet passage 18, on inner walls of the combustion space 20 and in particular on the valve head face 14 on the inlet valve 1.

For this purpose, the inlet valve 1 has a shaft 9 which according to the invention is not of solid construction but rather has a cavity 28 in its interior. The interior 28 has an elongated shape and is made in the shaft 9 for example by drilling. The cavity 28 extends starting from a junction area 31 between the valve head face 14 and shaft 9 in the direction of a longitudinal valve axis 5 of the inlet valve 1 and, in the closed state of the inlet valve 1, ends in the valve guide sleeve 7.

At an end area 29, located in the valve guide sleeve 7, of the cavity 28 the shaft 9 has at least one inlet shaft opening 30 which leads from an outer surface 34 of the shaft 9 into the cavity 28. The valve guide sleeve 7 also has an opening 36 which leads from an inner surface 37 to an outer surface 38 of the valve guide sleeve 7. The valve guide opening 36 is made in the valve guide sleeve 7 for example by drilling and extends for example transversely to the longitudinal valve axis 5 of the inlet valve 1. The valve guide opening 36 of the valve guide sleeve is connected to a pressure line 41 via a corresponding cylinder opening 40 in the cylinder head 3. The pressure line 41 is connected to a two way valve 44 which can be actuated electromagnetically, for example. The two way valve 44 is connected via a connection pressure line 42 to a compressed air vessel 45. The compressed air vessel 45 is connected via a compressed air vessel line 46 to a pump device 47, for example. The pump device 47 is constructed for example in the form of a diaphragm-driven air pump in which the pressure fluctuations produced in the crank shaft casing of the internal combustion engine by a piston as a result of its upward and downward movements are used for pumping a gaseous medium, for example air. When the internal combustion engine is operating, the compressed air vessel 45 can be refilled with air by the pump device 47 in specific operating ranges in order to make sufficient compressed air available in the compressed air vessel 45 in order to supply compressed air. In the open position of the two way valve 45, the pressure provided by the compressed air vessel 45 is present at the valve guide opening 36 of the valve guide sleeve 7 via the connection pressure line 42, the pressure line 41 and via the cylinder opening 40.

As illustrated in the drawing, in the closed position of the inlet valve 1 there is an axial space between the valve guide opening 36 of the valve guide sleeve 7 and the inlet shaft opening 30 of the shaft 9, the valve guide opening 36 being nearer to the combustion space 20 than the inlet shaft opening 30 of the shaft 9. Furthermore, in the transition area 31 between the shaft and valve head face 14 at least one outlet opening 50 is provided on the valve head 12, which outlet opening 50 is made in the valve head face 14, for example transversely with respect to the longitudinal valve axis 5, in order to produce a flow connection to the cavity 28 of the shaft 9. The axial space between the valve guide opening 36 and the inlet shaft opening 30 and their opening cross-sections are selected such that overlapping of the inlet shaft opening 30 with the valve guide opening 36 occurs at the transition from the closed position into the open position of the inlet valve 1, in particular in the area of the maximum opening position of the inlet valve 1, the inlet shaft opening 30 and the valve guide opening 36 leading into one another completely in the maximum open position of the inlet valve 1. When the openings 30, 36 overlap, compressed air flows from the pressure vessel 45 into the pressure line 41 via the connection pressure line 42 and the two way valve 44 which has been switched to the open position, and via the cylinder opening 40 into the valve guide opening 36 into the cavity 28 and back out of the valve head face 14 via the at least one outlet opening 50. Preferably, a plurality of inlet shaft openings 30 are provided on the circumference of the outer surface 34 of the shaft 9 so that even when the inlet valve 1 rotates a flow connection is present between the valve guide opening 36 and at least one of a plurality of inlet shaft openings 30. It is also conceivable to provide a plurality of valve guide openings 36 on the circumference of the outer surface 38 of the valve guide sleeve 7, which valve guide openings 36 then correspond for example to a plurality of slit-shaped inlet shaft openings 30 so that, in the open position of the inlet valve 1, a flow connection is always produced between the compressed air vessel 45 and the outlet opening 50 of the inlet valve 1. It is also possible for a circumferential groove to be made in the region of the valve guide opening 36 on the inner surface 37, with which circumferential groove the inlet shaft opening 30 can overlap in the open position in every rotational position of the inlet valve 1.

As the result of compressed air flowing out from at least one outlet opening 50 in the region of the valve head face 14, an air film, which essentially surrounds the valve head 12, is formed in the open position of the inlet valve 1. The air film prevents condensation of fuel droplets, which would otherwise take place, occurring in particular when the internal combustion engine is in the cold state and in certain operating ranges of the internal combustion engine, which fuel droplets then accumulate in particular on the valve head face 14. As is illustrated in the drawing, it is also possible to make a plurality of openings 50 in the valve head face 14, which outlet openings 50 lead radially to the cavity 28 for example from the transition area 31 between the valve head face 14 and the shaft 9, in order to produce a particularly uniform film of air on the valve head face 14 as a result of the outflowing air. It is also possible to provide, instead of or in addition to the outlet openings 50, further outlet openings 50 in the transition area 31 which are made for example in the valve head face 14 or in the outer surface 34 of the shaft 19, in particular in the vicinity of the valve head 12. The arrangement of the outlet openings 50 can be carried out such that a plurality of outlet openings 50 penetrate the valve head face 14 in a sieve-like manner. The compressed air which emerges from the plurality of outlet openings 50 produces a particularly uniform film of air which then surrounds the entire valve head face 14 with the valve head 12.

It is however also possible to construct the valve head face 14 with a rough surface which swirls the compressed air, on the rough surface, which emerges from an outlet opening 50 or for example from a plurality of outlet openings 50, in such away that a stream of air is formed around the valve head 12. A rough surface on the valve head face 14 can be produced for example by means of a sintering process in which a metal layer is applied to the valve head face 14 in order to produce a rough surface. In order to produce the outlet openings 50 and the rough surface of the valve head face 14 it is also possible to construct the inlet valve 1 in two parts, one part comprising for example the shaft 9 and one part comprising the valve head 12, the said parts being joined together again after the separate machining of the shaft 9 and valve head 12.

There is provision for compressed air to be expelled at the inlet valve 1, in particular during the cold start phase and the following warming up phase as well as in specific operating ranges of the internal combustion engine. The time when compressed air is supplied can be controlled on the one hand as a function of the selected state of the at least one valve guide opening 36 with respect to the at least one inlet shaft opening 30 and on the other hand of the two way valve 44. For this purpose, the two way valve is connected for example via an electric connection line 52 to an electronic control unit 53 which only moves the two way valve 44 into an opening position in specific operating ranges, in particular in the cold start phase of the internal combustion engine, in order to expel compressed air out of the inlet valve 1. The supply of compressed air is provided in particular during the first 120 seconds after the start of the internal combustion engine. It is however also possible to supply compressed air additionally in operating ranges of the internal combustion engine in which for example only a brief increase in harmful components in the exhaust gas occurs, for example under full load. Such operating ranges can be detected by the electronic control unit 53 by means of sensors connected to the control unit 53.

The compressed air emitted via the valve head face 14 of the valve head 12 also has the effect that an improved mixing of the fuel emitted by the fuel injection valve 24 takes place in particular in the combustion space 20. This leads to optimum combustion of the fuel in the combustion space 20, as a result of which the consumption of fuel of the internal combustion engine is also reduced. Furthermore, cooling of the inlet valve takes place as a result of the compressed air flowing in the cavity 28 and flowing out of the valve head 12 so that the thermal loading, in particular under full load of the internal combustion engine, is reduced, which results, inter alia, in an increase in the service life of the inlet valve 1.

What claim:

1. An inlet valve for a combustion space of an internal combustion engine, said inlet valve comprises a valve head (12) and a hollow shaft (9), a cavity (28) in said hollow shaft (9), said hollow shaft (9) has at least one inlet opening (30) in said shaft to said cavity (28) and at least one outlet opening (50) in said shaft from said cavity (28), said inlet opening (30) is provided in the shaft (9) and said outlet opening (50) is provided on a side of the inlet valve (1) facing away from the combustion space (20) of the internal combustion engine, said at least one inlet opening (30) is connected to a compressed air source for delivering compressed air to said at least one inlet opening (30), said delivered air flows from said at least one inlet shaft opening (30) to the cavity (28) in said inlet valve to said at least one outlet opening (50) in said shaft and out of said at least one outlet opening (50) whereby an air film overflows the valve head (12) facing away from the combustion space (20) of the engine whereby the flowing air prevents condensation of fuel droplets.

2. The inlet valve as claimed in claim 1, wherein the at least one outlet opening (50) is provided in a transition area (31) between the valve head (12) and shaft (9).

3. The inlet valve as claimed in claim 1, wherein the at least one outlet opening (50) is made in a valve head face (14), facing away from the combustion space (20) of the valve head (12).

4. The inlet valve as claimed in claim 1, wherein the at least one outlet opening (50) is made in an outer surface (34) of the shaft (9).

5. The inlet valve as claimed in claim 2, wherein a plurality of outlet openings (50) are provided which extend radially from the cavity (28) to the valve head (12).

6. The inlet valve as claimed in claim 1, wherein a valve head face (14), facing away from the combustion space (20) of the valve head (12), via which the medium emerging from the at least one outlet opening (50) flows, is made rough.

7. The inlet valve as claimed in claim 1, wherein the inlet valve (1) is produced from two parts, the shaft (9) and the valve head (12).

8. The inlet valve as claimed in claim 2, wherein the at least one outlet opening (50) is made in a valve head face (14), facing away from the combustion space (20) of the valve head (12).

9. The inlet valve as claimed in claim 3, wherein a plurality of outlet openings (50) are provided which extend radially from the cavity (28) to the valve head (12).

10. An inlet valve as claim in claim 1 which includes means for providing a compressed air, and means for controlling flow of compressed air to the inlet 30 of said valve shaft.

* * * * *